US010800580B2

(12) United States Patent
Cao

(10) Patent No.: US 10,800,580 B2
(45) Date of Patent: Oct. 13, 2020

(54) PLASTIC BOTTLE CAP WITH A SEALING STRUCTURE AND EASY TO ROTATE

(71) Applicant: Wen-Ling Cao, Shandong (CN)

(72) Inventor: Wen-Ling Cao, Shandong (CN)

( * ) Notice: Subject to any disclaimer, the term of this patent is extended or adjusted under 35 U.S.C. 154(b) by 339 days.

(21) Appl. No.: 15/885,865

(22) Filed: Feb. 1, 2018

(65) Prior Publication Data

US 2019/0177043 A1 Jun. 13, 2019

(30) Foreign Application Priority Data

Dec. 12, 2017 (CN) ..... 2017 1 1319941

(51) Int. Cl.
*B65D 41/04* (2006.01)

(52) U.S. Cl.
CPC ..... *B65D 41/0442* (2013.01); *B65D 41/0485* (2013.01)

(58) Field of Classification Search
CPC ..... B65D 41/0442; B65D 41/0435; B65D 41/0485; B65D 41/04; B65D 45/28; B65D 45/025; B65D 45/02; B65D 45/18; B65D 45/22
USPC ..... 215/293, 329, 315, 287, 280; 220/295, 220/293, 326, 304
See application file for complete search history.

(56) References Cited

U.S. PATENT DOCUMENTS 821,456 A * 5/1906 Bogelnnann ..... B65D 45/24 215/293
2,066,889 A * 1/1937 Murray ..... B65D 49/08 215/19
2004/0067091 A1* 4/2004 Tsutsunni ..... A45D 34/045 401/127

* cited by examiner

*Primary Examiner* — Robert J Hicks
(74) *Attorney, Agent, or Firm* — W&K IP

(57) ABSTRACT

A plastic bottle cap includes a plastic cap body. The bottom side of the cap body is an opening, and the inner wall of the cap body near the bottom side opening of the cap body is annularly provided with a groove. The sealing ring is installed in the groove, and one side of the sealing ring extends to the outside of the groove. The annular groove is opened around the inner ring of the bottle cap body. Two semi-circular rings are movably mounted in the annular groove, one end of the two semi-circular rings is rotatably connected by the first hinge, one end of the two semi-circular rings which far away from the first hinge is fixed with the first fixing block and the second fixing blocks respectively, and the first fixing block and the second fixing block correspond to the setting.

9 Claims, 5 Drawing Sheets

PLASTIC BOTTLE CAP WITH A SEALING STRUCTURE AND EASY TO ROTATE

FIELD OF THE INVENTION

The invention relates to the technical field of plastic bottle cap, especially relates to a plastic bottle cap with sealing structure and convenient rotation.

DESCRIPTION OF THE RELATED ART

The plastic bottle cap of the beverage bottle must have a good seal with the bottle opening of the beverage bottle to ensure that the interior of the beverage bottle is insulated from the outside so as to ensure the hygiene and safety of the beverage.

A conventional discloses a plastic bottle cap structure of a beverage bottle, The cap includes a bottle cap body and an anti-theft ring, the top edge of the anti-theft ring is connected by a number of bridge points with the bottom edge of the bottle cap body; The inner top surface of the bottle cap body is provided with an inner seal ring, a middle seal ring and an outer seal ring, The inner side of the bottle cap body has a threaded section, which has several longitudinal channels; The inner surface of the anti-theft ring is equipped with a continuous blade, which has several drainage holes in the root of the protection ring. The bottle cap provided by the utility model is combined with the bottle mouth of a beverage bottle, The inner seal ring, the middle seal ring and the outer seal ring are respectively sealed to the inner wall, the top surface and the outer corner of the bottle mouth to ensure the sealing effect; In addition, the channel and the drainage hole can smoothly exclude the overflow of the beverage or cleaning process between the bottle opening and the bottle cap, however, the existing beverage bottle cap is not easy to contact quickly when used, and it is easy to slip when rotating the cap, and has certain limitations in use.

BRIEF SUMMARY OF THE INVENTION

Based on the technical problems of background technology, the invention provides a plastic bottle cap having a sealed structure and being easy to rotate.

The invention discloses a plastic bottle cap having a sealing structure and convenient rotation, including plastic cap body. The bottom side of the cap body is an opening, and the inner wall of the cap body near the bottom side opening of the cap body is annularly provided with a groove. The sealing ring is installed in the groove, one side of the sealing ring extends to the outside of the groove. The annular groove is opened around the inner ring of the bottle cap body. Two semi-circular rings are movably mounted in the annular groove, one end of the two semi-circular rings is rotatably connected by the first hinge, one end of the two semi-circular rings which far away from the first hinge is fixed with the first fixing block and the second fixing blocks respectively, The first fixing block and the second fixing block correspond to the setting. A install groove is provided on a side of the first fixing block away from the second fixing block, A sliding hole is formed on an inner wall of one side of the install groove near the second fixing block, The sliding hole has a positioning rod, and both ends of the locating rod extend to the sliding hole, A positioning groove is provided on a side of the second fixing block near the first fixing block, One end of the positioning rod is slidably install in the positioning groove, A movable groove opened on the second fixing block is arranged on a side of the positioning groove away from the semi-circular ring, A passthrough hole is formed in an inner wall of one side of the movable groove near the positioning groove, A fixing rod is slidably installed in the passthrough hole, and both ends of the fixing rod extend outside the passthrough hole, The positioning rod is provided with a fixing hole located in the positioning groove, A fixing groove is formed on an inner wall of a side of the positioning groove away from the passthrough hole. One end of the fixing rod passes through the fixing hole and extends into the fixing groove.

Preferably, there are many arc-shaped grooves in the surrounding ring of the bottle cap body, the arc-shaped plate is movably installed in the arc-shaped groove, one side of the arc plate is rotatably connected with the inner wall of one side of the arc-shaped groove through a rotating shaft, and one side of the arc-shaped plate extends outside the arc-shaped groove.

Preferably, the arc-shaped plate is provided with a sliding groove on the outside arc-shaped groove, sliding block is installed on the sliding groove, and one side of the sliding block extends outside the sliding groove, and rotatingly installed arc-shaped rod, one end of the arc-shaped rod away from the sliding block is rotatably installed on a side of the cap body by the second hinge.

Preferably, clamping block is fixedly installed on the inner wall of the arc-shaped groove, a clamping groove is opened on a side of the arc-shaped plate away from the sliding groove, and the clamping block is matched with the clamping groove.

Preferably, the first sliding groove is arranged on the inner wall on both sides of the sliding hole, the first sliding block is slidably installed in the first sliding groove, one side of the first sliding block extends outside the first sliding groove, and is fixedly installed on the positioning rod.

Preferably, one side of the first sliding block is fixedly installed with the first spring, and one end of the first spring away from the first sliding block is fixedly installed on an inner wall of one side of the first sliding groove.

Preferably, the second sliding groove is arranged on the inner wall on both sides of the passthrough hole, the second sliding block is slidably installed in the second sliding groove, a side of the second sliding block is extended outside the second sliding groove and is fixedly installed on the positioning rod, the second spring sleeved on the fixing rod is fixedly installed on a side of the second sliding block far away from the positioning groove, One end of the second spring away from the second sliding block is fixedly installed on an inner wall of the side of the second sliding groove far away from the positioning groove.

Preferably, balls are rollingly installed on the inner walls of the passthrough hole and the fixing hole, and the balls are in contact with the fixing rod.

Preferably, a triangular passthrough hole is arranged on an inner wall of one side of the cap body, a circular cap is installed inside the cap body, a ring is fixedly installed on a side of the circular cap near the triangular passthrough hole.

The invention discloses a plastic bottle cap having a sealing structure and convenient rotation, through the cap body, the groove, the sealing ring, the annular groove, the semicircular ring, the first fixing block, the second fixing block, the installing groove, the sliding hole, the positioning rod, the positioning groove, the movable groove, the passthrough hole, the fixing rod, the fixing hole, the first sliding groove, the first sliding block, the first spring, the second sliding groove, the second sliding block and the second spring. sealing ring close contact with plastic bottle opening, when the plastic bottle cap needs to be opened, the fixing rod moves, the fixing rod slides in the passthrough hole, the fixing rod drives the second sliding block to slide in the second sliding groove, the second sliding block compresses the second spring, fixed rod out of the fixing groove and fixing hole, then, the positioning rod is moved, the positioning rod slides in the sliding hole, the positioning rod drives the first sliding block to slide in the first sliding groove, the first sliding block compresses the first spring, the positioning rod moves out of the positioning groove, open the two semi-circular ring can be quickly and easily open the cap body sealing structure, and the sealing structure is easy to reuse; through the arc-shaped groove, the arc-shaped plate, the sliding groove, the sliding block, the arc-shaped rod, the second hinge, the clamping block and the clamping groove, when the cap body is rotated, the arc-shaped plate is moved, the arc-shaped plate rotates in the arc-shaped groove through the rotating shaft, and the arc-shaped plate drives the clamping block to move out of the clamping groove; in the process of arc-shaped plate rotation drives the sliding block in the sliding groove, the sliding block drives the arc-shaped rod to rotate through the second hinge, so that the cap body can be conveniently and quickly rotated and prevented from slipping when the cap body is rotated. The present invention can quickly and conveniently open the sealing structure on the cap body, and the sealing structure is easy to reuse. At the same time, the cap body can be rotated quickly and conveniently to prevent the cap body from sliding when the cap body is rotated. The utility model has the advantages of simple structure and convenient use.

BRIEF DESCRIPTION OF THE SEVERAL VIEWS OF THE DRAWING(S)

Figure 1:
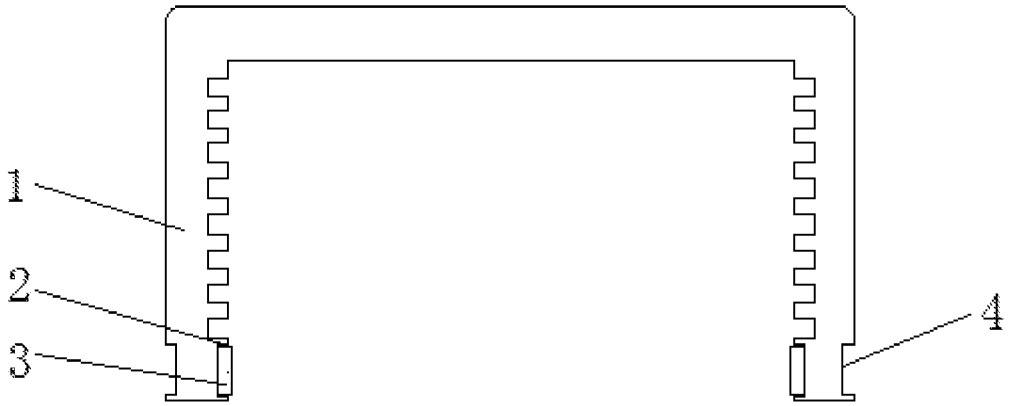
FIG. 1 is a schematic diagram of a plastic bottle cap with a sealed structure and easy to rotate.

In the figures: 1 cap body 2 groove 3 sealing ring 4 annular groove 5 semi-circular ring 6 the first fixing block 7 the second fixing block 8 mounting groove 9 sliding hole 10 positioning rod, 11 positioning groove 12 movable groove 13 through hole 14 fixing rod 15 fixing hole 16 fixing groove 17 the first sliding groove 18 the first sliding block 19 the first spring 20 the second sliding groove 21 the second sliding block 22 the second spring 23 arc-shaped groove 24 arc-shaped plate 25 slide groove 26 slide block 27 arc-shaped rod 28 the second hinge 29 fixture block 30 fixture groove 31 triangular through hole 32 Round uncover, 33 pull ring.

DETAILED DESCRIPTION OF THE INVENTION

The technical solutions in the embodiments of the present invention will be described clearly and completely hereinafter with reference to the figures in the embodiments of the present invention. Apparently, the described embodiments are merely a part but not all embodiments of the present invention.

EMBODIMENTS

Figure 2:
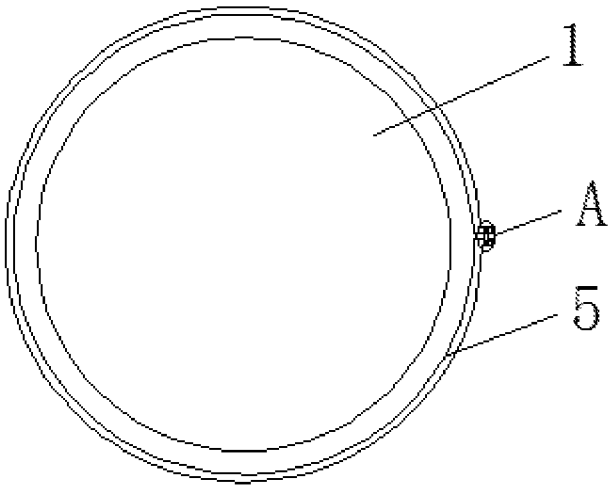
FIG. 2 is a schematic diagram of the overlook structure of a plastic bottle cap with a sealed structure and easy to rotate.
Figure 3:
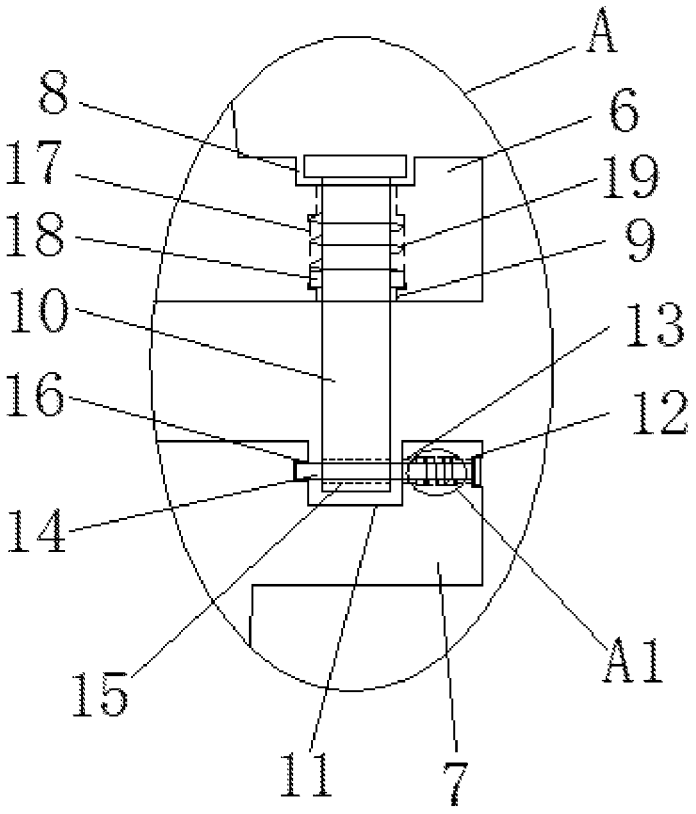
FIG. 3 is a schematic diagram of part A in FIG. 2 of a plastic bottle cap with a sealed structure and easy to rotate.
Figure 4:
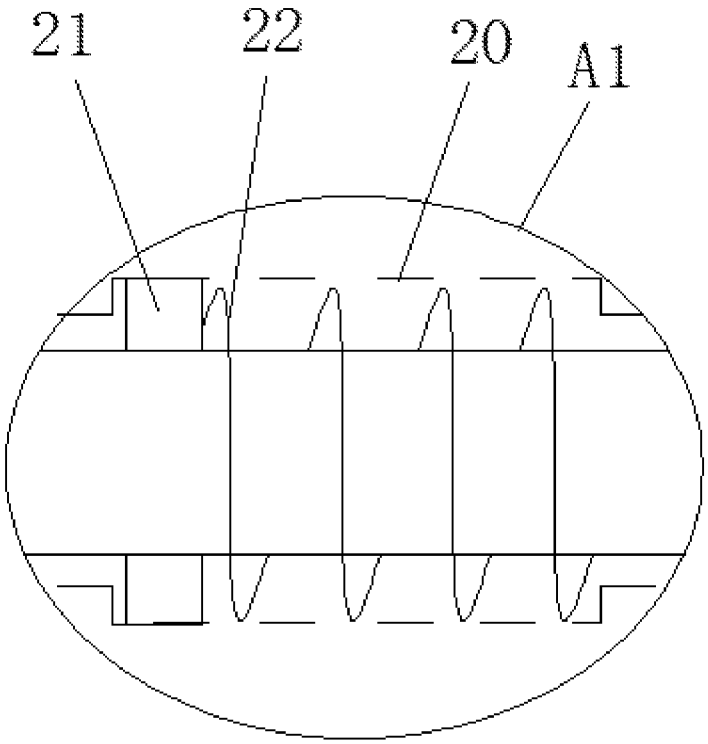
FIG. 4 is a schematic diagram of part A1 in FIG. 3 of a plastic bottle cap with a sealed structure and easy to rotate.
Figure 5:
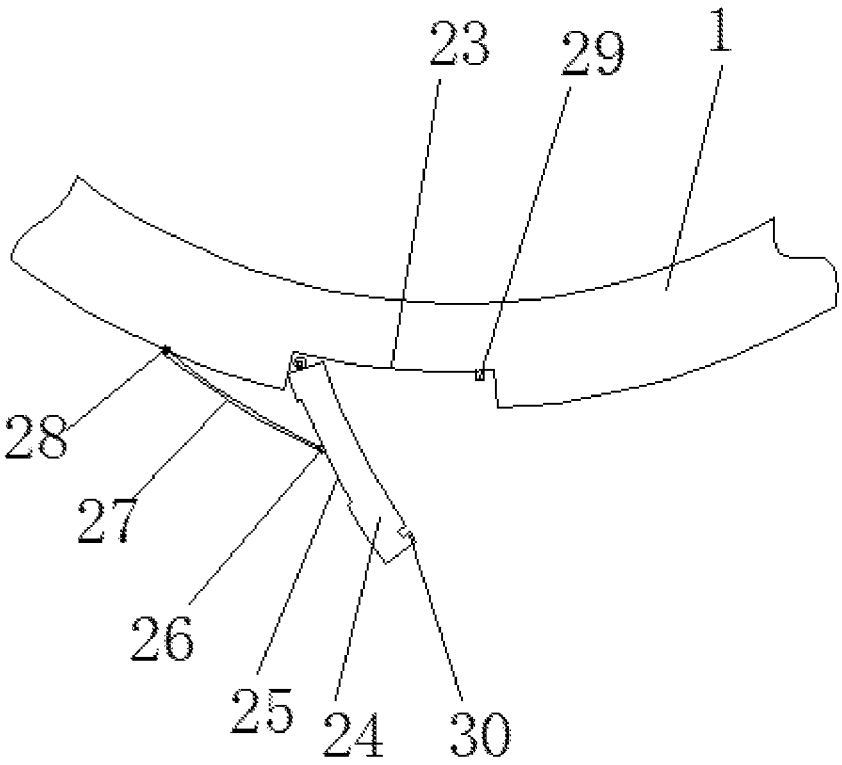
FIG. 5 is a schematic diagram of the connecting structure of the arc plate and the arc groove of a plastic bottle cap with a sealed structure and easy to rotate.
Figure 6:
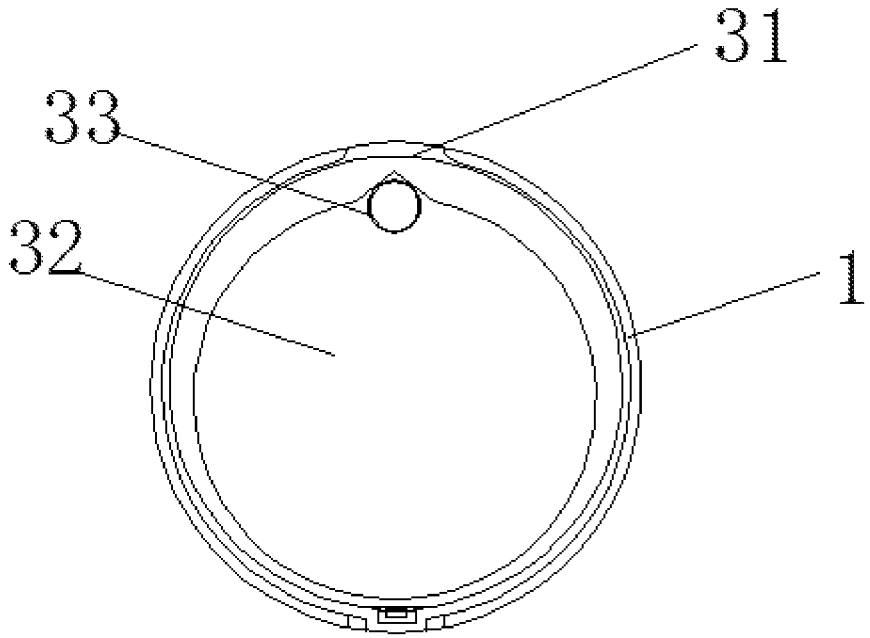
FIG. 6 is a schematic diagram of the overlook structure of a plastic bottle cap with a sealed structure and easy to rotate.

Refer to FIG. 1-6, a kind of sealed structure and easy to rotate plastic bottle caps, including cap body 1, the bottom side of the cap body 1 is open, and a groove 2 is opened on the inner wall of the inner wall of the opening of the 1 bottom side of the bottle cap body 1. A sealing ring 3 is fixedly installed in the groove 2, one side of the sealing ring 3 extends to the outside of the groove 2, an annular groove 4 is provided on the circumference of the bottle body 1, and two semi-circular rings 5 are movably installed in the annular groove 4. One end of the two semi-circular rings 5 is rotatably connected by the first hinge, the two semi-circular rings 5 are respectively fixedly mounted with the first fixed block 6 and the second fixed block 7 away from one end of the first hinge, the first fixed block 6 and the second fixed block 7 correspondingly disposed;

A mounting groove 8 is provided on a side of the first fixing block 6 away from the second fixing block 7, a sliding hole 9 is formed on an inner wall of a side of the mounting groove 8 adjacent to the second fixing block 7, a positioning rod 10 is slidably mounted in the sliding hole 9, And both ends of the positioning rod 10 extend to the outside of the sliding hole 9. A positioning groove 11 is provided on a side of the second fixing block 7 close to the first fixing block 6. One end of the positioning rod 10 is slidably mounted and positioned in the positioning groove 11. The side of the groove 11 away from the semi-circular ring 5 is provided with a movable groove 12 which is opened on the second fixing block 7. A through hole 13 is opened on the inner wall of one side of the movable groove 12 adjacent to the positioning groove 11, The fixing rod 14, and both ends of the fixing rod 14 extend to the through hole 13, The positioning rod 10 is provided with a fixing hole 15 located in the positioning. An inner wall of the positioning groove 11 away from the through hole 13 is provided with a fixing groove 16. One end of the fixing rod 14 penetrates the fixing hole 15 and extends into the fixing groove 16. Through the cap body 1, the groove 2, the sealing ring 3, the annular groove 4, the semi-circular ring 5, the first fixing block 6, the second fixing block 7, the mounting groove 8, the sliding hole 9, the positioning rod 10, positioning groove 11, movable groove 12, through hole 13, fixing rod 14, fixing hole 15, fixing groove 16, the first sliding groove 17, the first sliding block 18, the first spring 19, the second sliding groove 20, the second sliding block 21 and the second spring 22 used in combination, the sealing ring 3 is in close contact with the plastic bottle mouth, when the plastic bottle cap needs to be opened, the fixing rod 14 is moved, the fixing rod 14 slides in the through hole 13, the fixing rod 14 drives the second sliding block 21 to slide in the second sliding groove 20. The second sliding block 21 compresses the second spring 22, the fixing rod 14 moves out of the fixing groove 16 and the fixing hole 15, and then moves the positioning rod 10, the positioning rod 10 slides in the sliding hole 9, The positioning rod 10 drives the first sliding block 18 to slide in the first sliding groove 17, the first sliding block 18 compresses the first spring 19, the positioning rod 10 moves out of the positioning groove 11 and opens the two semi-circular rings 5, so as to facilitate quick and convenient opening of the sealing structure on the cap body 1 and the sealing structure is easy to reuse; Through the arc-shaped groove 23, the arc-shaped plate 24, the slide groove 25, the slide block 26, the arc-shaped groove 27, the second hinge 28, the fixture block 29 and fixture groove 30 used in combination, When the cap body 1 is rotated, the arc-shaped plate 24 is moved and the arc-shaped plate 24 rotates in the arc-shaped groove 23 through the rotation shaft, and the arc-shaped plate 24 drives the fixture block 29 to move out of the fixture groove 30. During the rotation of the arc-shaped plate 24, the slide block 26 slides in the slide groove 25 and the slide block 26 drives the arc-shaped groove 27 to rotate through the second hinge 28. so as to rotate the cap body 1 conveniently and quickly and prevent the cap body 1 from rotating when sliding. The present invention can quickly and conveniently open the sealing structure on the cap body 1, and the sealing structure is easy to reuse. At the same time, the cap body 1 can be conveniently and quickly rotated to prevent the cap body 1 from rotating when the cap body 1 is rotated. The utility model has the advantages of simple structure and convenient use.

A plurality of arc-shaped grooves 23 are evenly arranged on the circumference of the bottle cap body 1, arc-shaped plates 24 are movably mounted in the arc-shaped grooves 23, one side of the arc-shaped plate 24 is rotatably connected with an inner wall of one side of the arc-shaped groove 23 through a rotating shaft, and one side of the arc-shaped plate 24 extends to the outside of the arc-shaped groove 23. A slide groove 25 is formed at a side of the arc-shaped plate 24 outside the arc-shaped groove 23. A slide block 26 is slidably mounted in the slide groove 25, and one side of the slide block 26 extends to the outside of the slide slot 25 and is rotatably mounted with an arc-shaped rod 27. One end of the arc-shaped rod 27 away from the slide block 26 is rotatably mounted on one side of the bottle cap body 1 through the second hinge 28, An inner wall of the arc-shaped groove 23 is fixedly provided with a fixture block 29. A side of the arc-shaped plate 24 away from the slide slot 25 is provided with a fixture groove 30, and the fixture block 29 is matched with the fixture groove 30.

The first sliding groove 17 is opened on both inner walls of the sliding hole 9, the first sliding block 18 is slidably mounted inside the first sliding groove 17, one side of the first sliding block 18 extends outside the first sliding groove 17, and the first spring 19 is fixedly mounted on one side of the first sliding block 18 and one end of the first spring 19 away from the first sliding block 18 is fixedly mounted on an inner wall of one side of the first sliding groove 17 The second inner wall of the through hole 13 is provided with the second sliding groove 20, the second sliding block 21 is slidably mounted in the second sliding groove 20, one side of the second sliding block 21 extends outside the second sliding groove 20 and is fixedly mounted on the fixing rod 14, the second spring 22 sleeved on the fixing rod 14 is fixedly mounted on a side of the second sliding block 21 far away from the positioning groove 11, the end of the second spring 22 away from the second sliding block 21 is fixedly mounted on the inner wall of the side of the second sliding groove 20 far away from the positioning groove 11, The inner wall of the through hole 13 and the fixing hole 15 are rollingly mounted with balls, the balls are in contact with the fixing rod 14, a triangular through hole 31 is arranged on the inner wall of one side of the bottle cap body 1, round uncover 32 is installed in the bottle cap body 1, a pull ring 33 is fixedly mounted on a side of the round uncover 32 close to the triangular through hole 31. Through the cap body 1, the groove 2, the sealing ring 3, the annular groove 4, the semi-circular ring 5, the first fixing block 6, the second fixing block 7, the mounting groove 8, the sliding hole 9, the positioning rod 10, the positioning groove 11, movable groove 12, through hole 13, fixing rod 14, fixing hole 15, fixing groove 16, the first sliding groove 17, the first sliding block 18, the first spring 19, the second sliding groove 20, the second sliding block 21 and the second spring 22 used in combination, the sealing ring 3 is in close contact with the plastic bottle mouth, when the plastic bottle cap needs to be opened, the fixing rod 14 is moved and the fixing rod 14 slides in the through hole 13, the fixing rod 14 drives the second sliding block 21 to slide in the second sliding groove 20, the second sliding block 21 compresses the second spring 22, the fixing rod 14 moves out of the fixing groove 16 and the fixing hole 15, and then moves the positioning rod 10 and the positioning rod 10 slides in the sliding hole 9, the positioning rod 10 drives the first sliding block 18 to slide in the first sliding groove 17. The first sliding block 18 compresses the first spring 19, the positioning rod 10 moves out of the positioning groove 11 and opens the two semi-circular rings 5, which can facilitate the quick and convenient opening of the sealing structure on the cap body 1 and the sealing structure is easy to be reused; The arc-shaped groove 23, the arc-shaped plate 24, the slide groove 25, the slide block 26, the arc-shaped rod 27, the second hinge 28, the fixture block 29 and the fixture groove 30 cooperate to rotate the cap body 1, the arc-shaped plate 24 rotates in the arc-shaped groove 23 through the rotating shaft, and the arc-shaped plate 24 drives the fixture block 29 to move out of the fixture groove 30. During the rotation of the arc-shaped plate 24, the slide block 26 is driven to slide in the slide groove 25. The arc-shaped rod 27 is driven by slide block 26 through the second hinge 28 to rotate conveniently and quickly so as to prevent the cap body 1 from slipping when the cap body 1 is rotated; The present invention can facilitate the quick and convenient opening of the sealing structure on the cap body 1 and the sealing structure is easy to be reused, and at the same time, the cap body 1 can be conveniently and rapidly rotated to prevent the cap body 1 from rotating when the cap body 1 is rotated. The utility model has the advantages of simple structure and convenient use.

The present invention: the sealing ring 3 is in close contact with the plastic bottle mouth, when the plastic bottle cap needs to be opened, the fixing rod 14 is moved and the fixing rod 14 slides in the through hole 13, the fixing rod 14 drives the second sliding block 21 to slide in the second sliding groove 20, the second sliding block 21 compresses the second spring 22, the fixing rod 14 moves out of the fixing groove 16 and the fixing hole 15, and then moves the positioning rod 10 and the positioning rod 10 slides in the sliding hole 9, and the positioning rod 10 drives the first sliding block 18 to slide in the first sliding groove 17, the first sliding block 18 compresses the first spring 19, the positioning rod 10 moves out of the positioning groove 11 and opens the two semi-circular rings 5, so as to achieve the purpose of quickly and conveniently opening the sealing structure on the cap body 1 and the reuse of the sealing structure; When rotating the cap body 1, the arc-shaped plate 24 is moved, the arc-shaped plate 24 rotates in the arc-shaped groove 23 through the rotation shaft, and the arc-shaped plate 24 drives the fixture block 29 to move out of the fixture groove 30, and during the rotation of the arc-shaped plate 24, the sliding block 26 slides in the slide groove 25. The slide block 26 drives the arc-shaped rod 27 to rotate through the second hinge 28 so as to rotate the cap body 1 conveniently and rapidly to prevent the cap body 1 from slipping.

The foregoing descriptions are merely preferred embodiments of the present invention, but the protection scope of the present invention is not limited thereto. Any technical personnel skilled in this technology field shall be within the scope of the technology disclose by the present invention, any equivalent substitutions or changes to the technical solutions of the present invention and the inventive concept thereof should be included in the protection scope of the present invention.

The invention claimed is:

1. A plastic bottle cap with sealing structure and convenient rotation, including a bottle cap body (1), wherein a bottom side of the cap body (1) is an opening, and a groove (2) is annularly formed on an inner wall near a bottom opening of the cap body (1), a sealing ring (3) is fixedly mounted in the groove (2), one side of the sealing ring (3) extends outside the groove (2), the cap body (1) is provided with an annular groove (4) in a periphery of the cap body, two semi-circular rings (5) are movably installed in the annular groove (4), one end of the two semi-circular rings (5) is rotatably connected by a first hinge, one end of the two semi-circular rings (5) which far away from the first hinge is fixed with a first fixing block (6) and a second fixing block (7) respectively;

wherein an install groove (8) is provided on a side of the first fixing block (6) away from the second fixing block (7), a sliding hole (9) is formed on an inner wall of one side of the install groove (8) near the second fixing block (7), the sliding hole (9) has a positioning rod (10), and both ends of a locating rod (10) extend to the sliding hole (9), a positioning groove (11) is provided on a side of the second fixing block (7) near the first fixing block (6), one end of the positioning rod (10) is slidably installed in the positioning groove (11), a movable groove (12) opened on the second fixing block (7) is arranged on a side of the positioning groove (11) away from the semi-circular ring (5), a passthrough hole (13) is formed in an inner wall of one side of the movable groove (12) near the positioning groove (11), a fixing rod (14) is slidably installed in the passthrough hole (13), and both ends of the fixing rod (14) extend outside the passthrough hole (13), the positioning rod (10) is provided with a fixing hole (15) located in the positioning groove (11), a fixing groove (16) is formed on an inner wall of a side of the positioning groove (11) away from the passthrough hole (13), one end of the fixing rod (14) passes through the fixing hole (15) and extends into the fixing groove (16).

2. The plastic bottle cap as claimed in claim 1, wherein a plurality of arc-shaped grooves (23) are uniformly opened on a circumference of the bottle cap body (1) an arc-shaped plate (24) is movably installed in the arc-shaped grooves (23), one side of the arc-shaped plate (24) is rotatably connected with one inner wall of the arc-shaped groove (23) through a rotating shaft, and one side of the arc-shaped plate (24) extends outside the arc-shaped groove (23).

3. The plastic bottle cap as claim in claim 2, wherein the arc-shaped plate (24) is provided with a sliding groove (25) on a side outside the arc-shaped groove (23), a sliding block (26) is slidably installed in the sliding groove (25), and one side of the sliding block (26) extends outside the sliding groove (25) and is rotatably installed with an arc-shaped rod (27), one end of the arc-shaped rod (27) away from the sliding block (26) is rotatably installed on one side of the cap body (1) through a second hinge (28).

4. The plastic bottle cap as claim in claim 2, wherein an arc-shaped groove (23) is fixedly installed on an inner wall with a clamping block (29); a side of the arc-shaped plate (24) away from the sliding groove (25) is provided with a groove (30), and the clamping block (29) is matched with the groove (30).

5. The plastic bottle cap as claimed in claim 1, wherein the sliding hole (9) both sides of the inner wall have the first slide groove (17) a first sliding block (18) is slidably installed in a first sliding groove (17), one side of the first sliding block (18) extends outside the first sliding groove (17) and is fixedly installed on the positioning rod (10).

6. The plastic bottle cap as claim in claim 5, wherein a first spring (19) is fixedly installed on one side of the first sliding block (18) and a side of the first spring (19) far away from the first sliding block (18) is fixedly installed on a side of the first sliding groove (17).

7. The plastic bottle cap as claimed in claim 1, wherein the inner wall of the passthrough hole (13) has a second slide groove (20), a second sliding block (21) is slidably installed in the second sliding groove (20), one side of the second sliding block (21) extends outside the second sliding groove (20) and is fixedly installed on the fixing rod (14), a second spring (22) sleeved on the fixing rod (14) is fixedly installed on a side of the second sliding block (21) away from the positioning groove (11), an end of the second spring (22) away from the second sliding block (21) is fixedly installed on an inner wall of the side of the second sliding groove (20) away from the positioning groove (11).

8. The plastic bottle cap as claimed in claim 1, wherein balls are roll-installed on inner walls of the passthrough hole (13) and the fixing hole (15), and the balls are in contact with the fixing rod (14).

9. The plastic bottle cap as claimed in claim 1, wherein a triangular passthrough hole (31) is opened on one inner wall of the cap body (1), the bottle cap body (1) has a round cover (32) inside, a pull ring (33) is fixedly installed on a side of the round cover (32) near the triangular passthrough hole (31).

* * * * *